United States Patent [19]

Begluitti

[11] Patent Number: 4,558,976

[45] Date of Patent: Dec. 17, 1985

[54] QUICK FIX DRILL WRENCH

[76] Inventor: John H. Begluitti, Rte. 4, Box 352A, New Tazewell, Tenn. 37825

[21] Appl. No.: 577,213

[22] Filed: Feb. 6, 1984

[51] Int. Cl.[4] ..... E21B 15/00; E21B 17/00

[52] U.S. Cl. ..... 408/226; 175/300

[58] Field of Search ..... 403/300, 308; 285/14; 29/26 A; 408/226, 239 R; 175/300, 320

[56] References Cited

U.S. PATENT DOCUMENTS 3,519,091 7/1970 Leibee et al. ..... 175/320

4,190,125 2/1980 Emmerich et al. ..... 175/320 X

FOREIGN PATENT DOCUMENTS 194948 3/1965 Sweden ..... 403/300

*Primary Examiner*—Eugene F. Desmond

*Attorney, Agent, or Firm*—Pitts and Brittian

[57] ABSTRACT

Drill wrench apparatus for use with a drill bit, drilling steel, and a drive source for drilling a hole in the ceiling of a mine is disclosed. The drill wrench (18) includes a first end (50) having a non-circular aperture (58) suitable for receiving a hexagon-shaped drill bit shaft and the square head of a ceiling bolt. A central portion (52) connects first end (50) to second end (54) which also defines a non-circular aperture (38) extending through the wrench (18) to allow the removal of drill dust and debris. The second end (54) is cylindrically shaped, and includes pipe threads (62) on the outside surface suitable for meshing with threads (74) on the inside surface of a binding ring (72). The second end has a non-circular aperture (63) for receiving a hexagonal drill steel, and also defines a conical end surface (64). Binding ring (72) includes a bearing surface (76) for forcing a resilient annular shaped member (68) into the concave recess (64). Thus when a drill steel (20) is inserted in aperture (63), resilient member (68) positioned around drill steel (20) may be forced into recess (64) such that it tightly grasps drill steel (20) to prevent unintentional separation of the drill steel from the wrench.

10 Claims, 6 Drawing Figures

QUICK FIX DRILL WRENCH

TECHNICAL FIELD

This invention relates to apparatus for drilling suitable holes in the ceiling of a mine for the installation of mine ceiling bolts. More particularly, the apparatus of this invention relates to a drill wrench which works in conjunction with a drill bit for drilling such ceiling holes and which also allows the selection of any desired length of hexagon shaped drill steel commonly used as a part of mining equipment. Specifically, the drill wrench of this invention allows a length of drill steel to be readily detached or attached to the wrench without requiring welding as was required by previous techiques.

BACKGROUND ART

As will be appreciated by those skilled in the art, a drill wrench is used with apparatus for drilling holes in a mine ceiling and is also commonly used for driving the ceiling bolts into place. In the usual situation a long drill bit and the shaft, usually a piece of drill steel between 2 and 4 feet long, is used to drill a hole into the ceiling of a mine. After drilling the hole, a ceiling bolt is provided for anchoring and helping to support the ceiling so that it does not collapse. In the drilling process, a drill bit is typically fitted into a first end of the hexagon shaped drill steel, which acts as a shaft, and the other end of the drill steel attaches with a sliding fit into a drill wrench. The back end of the drill wrench typically has welded thereto a selected length of hexagon shaped drill steel or a round steel with a hexagon shaped bottom shaft, which in turn fits into a rotating drill head for providing power to the drill bit. The hole is drilled in the mine ceiling, the drill bit and steel attached to the drill bit is removed and a ceiling bolt (commonly with a square head) is inserted into the hole. Many techniques are used for securing the ceiling bolt into the hole, although perhaps the preferable means in modern techniques is to include a quantity of epoxy material at the end of the ceiling bolt which is activated and dries in place when the ceiling bolt itself is driven in place and related to epoxy manufacturer's specifications.

In a typical operation using the techniques available today, it is not uncommon for the length of drill steel which is welded to the back side of the drill wrench to break at the weld point of the drill wrench. Unfortunately, such a break usually results in a significant loss of time and requires immediate repairs. If another drill wrench which has the desired size of drill steel attached is not available, then the broken piece must be sawed away with a hack saw or other metal cutting device and a new piece of drill steel welded thereto. Obviously in the mining environment the use of open flame or sparks from welding are dangerous, and must be done only after proper checking for methane gases and adequate ventilation. Consequently, such repairs often must take place outside of the mine shaft itself.

A search of the applicable classes and references was made with respect to the present invention. Consequently several patents related somewhat to the present idea were found, but none of these patents included the details and features of the present invention. For example, U.S. Pat. No. 2,735,704 issued to B. E. R. Lofqvist on Feb. 21, 1956 discloses a coupling device for joining two hexagon shaped pieces of drill steel of the type used for rock drilling. According to the U.S. Pat. No. 2,735,704 the two pieces of steel are joined by a friction fitting sleeve which fits on the outside of the two matching or mating pairs of drill steel. A pair of dimples are included at the mating ends of the two pieces of steel. These dimples cooperate with a spring loaded key member which itself cooperates with the outside sleeve for holding the two matching pairs of drill steel together.

U.S. Pat. No. 3,519,091 issued to D. L. Leibee, et al. on July 7, 1970 on the other hand discloses the use of a hexagon shaped end on a drive head which includes a split ring such that the hexagon shaped insert will fit tightly and firmly within the interior wall of a hexagon shaped drill steel. The patent also shows how additional lengths of drill steel may be added to increase the length by the use of a double ended mating piece which extends into the interior of two separate pieces of hexagon drill steel.

U.S. Pat. No. 4,009,760 issued to L. B. Hansen, et al. on Mar. 1, 1977 discloses the use of specific types of drilling extensions which come in selected lengths such that the overall length of the drill bit may be extended. However, it is clearly seen that this type device is not compatible with the commonly used hexagon shaped drill steel, driving heads and drill bits.

Similarly, the U.S. Pat. No. 4,226,290 issued to L. H. McSweeney on Oct. 7, 1980 discloses the use of both square shaped and hexagon shaped drives. This patent also provides a good discussion of the actual drilling machinery used for drilling ceiling holes. However, clearly this invention does not disclose the type drilling wrench described in the following discussion.

Therefore, it is an object of the present invention to provide a drill wrench which may be used with various selected lengths of drill steel, and which allows for immediate repair without open flame or spark in the event the drill steel breaks.

It is another object of the present invention to provide an inexpensive drill wrench which can readily be attached to existing machinery and used with existing drill steel.

It is a further object of this invention to provide a new and improved drill wrench which allows for ready exchange of the length of drill steel driving the wrench and bit.

And it is another object of this invention to provide a new and improved drill wrench which is completely compatible with existing drill bits, drive heads and hexagon shaped drill steel.

DISCLOSURE OF THE INVENTION

Other objects and advantages will be obvious, and will in part appear hereinafter, and will be accomplished by the present invention which provides drill wrench apparatus for use with a bit member, drill steel, and a drive source for drilling holes in the roof of a mine. The holes once drilled are suitable for receiving ceiling bolts for supporting and preventing collapse of the mine ceiling. The drill wrench of this invention comprises an elongated body portion having a first end, a central portion and a further end. The first end defines a first selected noncircular aperture for receiving with a sliding fit the shaft of a drill bit or typically the hexagon shape of a piece of drive steel which in turn is attached to the drill bit. The central portion joins the first end just discussed to a second end. In addition, the central portion also defines an axial aperture which therethrough allows for an air passage for removing debris and rock and coal dust from the hole being drilled. The axial aperture through the central portion is in register with the first selected noncircular aperture of the first end. The further end is joined to the central portion, and has a cylindrical shape and also defines a selected noncircular aperture for receiving with a sliding fit the end of a drill steel. A blocking ledge is included at a selected distance from the second end such that the drill steel extends said selected distance within said wrench. Typically, the noncircular aperture of the first end and the noncircular aperture of a second end both are suitable for receiving the same size hexagon shaped drill steel members. The second noncircular aperture defined in the further end, is also in register with the axial aperture extending through the central portion. In addition, the exterior surface of the further end is cylindrically shaped and has included thereon threads, such as pipe threads. In addition, the further end also defines a concave area which is axially centered with the cylindrical shape and is suitable for receiving a resilient member. The resilient member itself is annularly shaped and is received in the concaved area of the further end such that it fits snugly around a drill steel which has been inserted in the second selected noncircular aperture of the further end. A binding ring encircles the inserted drill steel and has a surface for bearing against and providing force to the resilient member. To accomplish this, the binding ring has a size and threads on the inside surface of the ring for meshing and cooperating with the threads on the outside surface of the cylindrical shaped further end such that the resilient member may be forced into the concaved area by the bearing surface when the ring is threaded onto the threaded further end. By tightening the binding ring against the resilient member, the drill steel is tightly grasped by the resilient member such that it is retained in the second selected noncircular aperture and cannot be readily dislodged without loosening the binding ring. In a preferred embodiment, the first end of the wrench defines the noncircular aperture which is suitable for both receiving the hexagon shaped drill steel as discussed above, as well as a square head of a ceiling bolt commonly used in supporting such a ceiling. In addition, the resilient member may be made of a material selected from a group consisting of rubber, nylon, neoprene and plastic.

BRIEF DESCRIPTION OF THE DRAWINGS

The above mentioned features of the present invention will be more clearly understood from consideration of the following description in connection with the accompanying drawings in which.

BEST MODE FOR CARRYING OUT THE INVENTION

Figure 1:
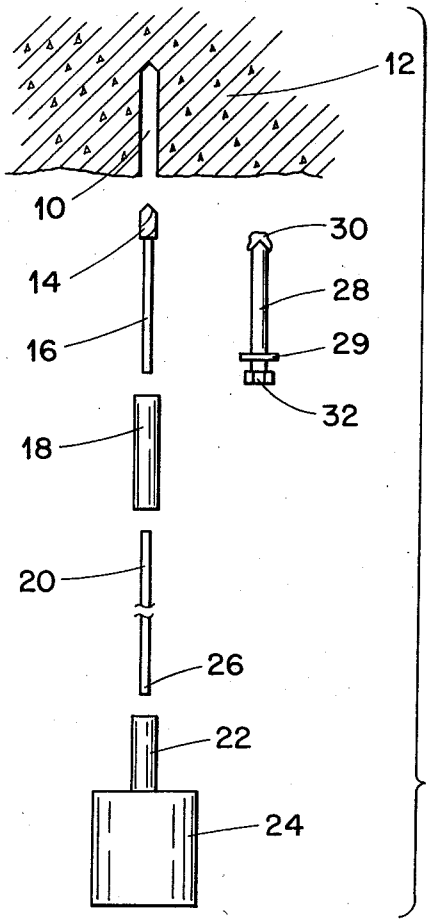
FIG. 1 shows a pictorial view of typical apparatus including a drill bit, drill steel and a drill head driven by a power source along with a drill wrench for drilling holes into the ceiling of a mine.

Referring now to FIG. 1 there is shown typical apparatus for drilling a selected length hole 10 in the ceiling 12 of a mine. As shown, a drill bit 14 typically attached to a length of drill steel 16 is supported by a drill wrench 18. Hereinafter, drill steel 16 may alternately be described as the shaft of the drill bit. The drill wrench 18 itself is attached to a second piece of drill steel 20 which in turn is rotated by a drill head 22 powered by a power source or a drilling mechanism 24. Thus, in operation it will be appreciated that as the power source 24 drives the drill head 22, the drill steel 20, the drill wrench 18, and the drill bit 14 are rotated such that when they are pressed against the ceiling 12 a hole 10 is provided. According to present day techniques and equipment, it has been found that hexagon shaped drill steel provides advantages in the mine environment. Consequently, in the most typical operation the drill steel 16 and the drill steel 20 will have a hexagon shaped cross-section. Also of importance to understand is that the piece of drive drill steel 16, the drill wrench 18, and the drill steel 20 all include a aperture extending axially therethrough such that a vacuum or airflow may be applied to the lower most portion 26 of the drill steel 20 such that drilling dust of rock and coal may be withdrawn. This avoids binding of the drill bit in the hole 10. It will also be appreciated, of course, that although hexagon shaped drill steel is commonly used, any non-circular drill steel including as examples only, square or oval, could also be used.

Once the hole 10 has been drilled to the desired depth or selected length, a ceiling bolt such as shown at 28 will then be driven into place along with a large washer or plate 29 to help secure the mine ceiling. Although several techniques have been used in the past and may be used today for anchoring the ceiling bolt 28 into hole 10, the preferred technique now being used in most mines is to include a quantity of epoxy 30 on the end opposite head 32 of ceiling bolt 28 such that when the ceiling bolt 28 is fully positioned in the hole 10 and related to epoxy manufacturer's specifications the epoxy is activated and binds the bolt permanently into position.

Figure 2:
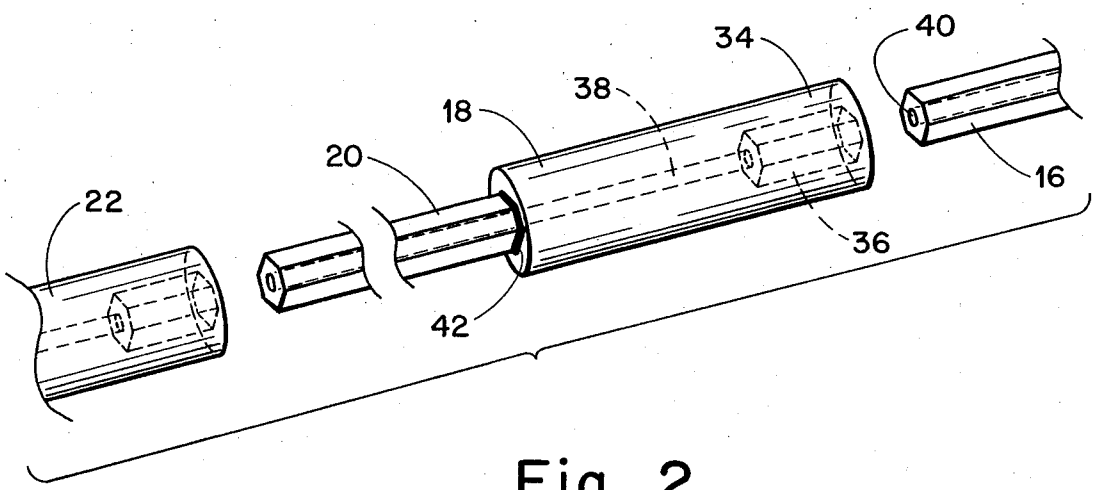
Fig. 2 PRIOR ART
FIG. 2 shows a typical prior art drill wrench commonly used in the apparatus of FIG. 1.

Referring now to FIG. 2, there is shown in detail a typical prior art drilling wrench 18. As shown, the drill wrench 18 includes a first end 34 which defines a hexagon shaped aperture 36 for receiving a hexagon shaped drill steel 16, which is attached to the drill bit (not shown), or in some cases the hexagon end of a drill bit itself. Also, as was discussed heretofore with respect to FIG. 1, aperture 38 extends through the body of the drill wrench 18 and on through the length of drill steel 20. This aperture 38 cooperates with the aperture 40 carried through the length of drill steel 16.

In the typical prior art arrangement, the length of drill steel 20 was permanently attached to the wrench 18 by means of welding as shown by welding bead 42. Thus it will be appreciated that according to the technique used in the prior art, a large number of wrenches with selected lengths of drill steel 20 must be available depending upon the height of the mine ceiling itself. Further, as will be appreciated by those skilled in the art it is not uncommon that the drill steel 20 will break at a point adjacent the weld point 42, such that the drilling operation must be stopped until a new wrench can either be placed into operation or the broken wrench repaired. Typically, to repair the wrench the nub of steel remaining after the break must be removed (typically by a hack saw) from the wrench 18 and a new length of selected drill steel welded on. It will be appreciated of course that welding within a mine shaft itself is a dangerous and usually a time-consuming operation and therefore such repairs often take place outside of the mine itself.

Figure 3B:
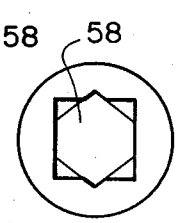
FIGS. 3A, 3B and 3C show a side view and a top view and bottom view, respectively, of the elongated body portion of the drill wrench of this invention.
Figure 3A:
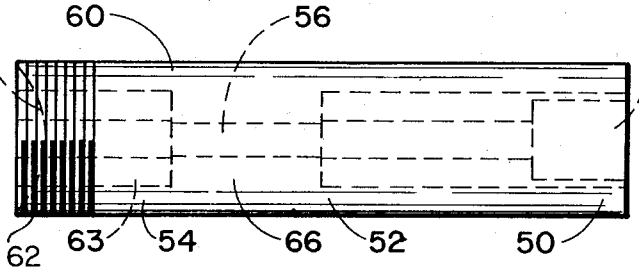
Figure 3C:
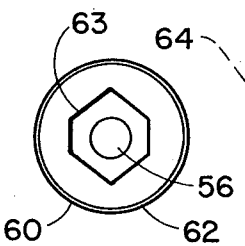

Referring now to FIGS. 3A, 3B and 3C, there is shown a side view, a top view and a bottom view, respectively, of the new and improved drill wrench of this invention. As shown, the drill wrench of this invention includes a first end portion 50, a central portion 52 and a further end portion 54. As was discussed in the prior art wrench of FIG. 2, there is also included an aperture 56 extending axially through the body of the drill wrench. Also as seen, the first end 50 defines a noncircular aperture 58 which is suitable for receiving a hexagon shaped piece of drill steel operating as the shaft of a drill bit. However, in a preferred embodiment, and as can be more clearly seen in the top view of FIG. 3B the aperture 58 is not only suitable for receiving the hexagon shaped drill steel, but is also designed to receive the square head of a ceiling bolt such that the wrench may be used to seat the ceiling bolt in position. Thus, referring to FIG. 3B, it can be seen that the hexagon shaped drill steel can drive both a wrench as well as the square shaped head of a ceiling bolt.

Referring again to FIG. 3A, and to FIG. 3C, it can be seen that the end 54 is cylindrically shaped and includes on its outside cylindrical surface 60 threads such as pipe threads 62. In addition, as can be seen, end 54 further defines a hexagon shaped aperture 63 for receiving a hexagon shaped drill steel and which in a preferred embodiment is equivalent to the hexagon shape 58 defined in the first end 50. Also as can be seen, there is a concaved area 64 having its center at the axial center of the drill wrench itself. As will be discussed hereinafter, this concaved portion 64 is suitable for receiving a resilient member comprising an element of this invention.

Also as shown in the side view of FIG. 3A, there is a blocking ledge or member 66 such that when a drill steel is inserted as a sliding fit into aperture 63, it will bottom out or lodge against the blocking ledge 66. Thus, it can be seen to this point that a hexagon shaped and rotating drill steel inserted into aperture 63 will result in the wrench itself rotating which will in turn rotate the hexagon shaped drill shaft of a drill bit or a square head of a ceiling bolt inserted in the aperture 58 of end 50.

Figure 4:
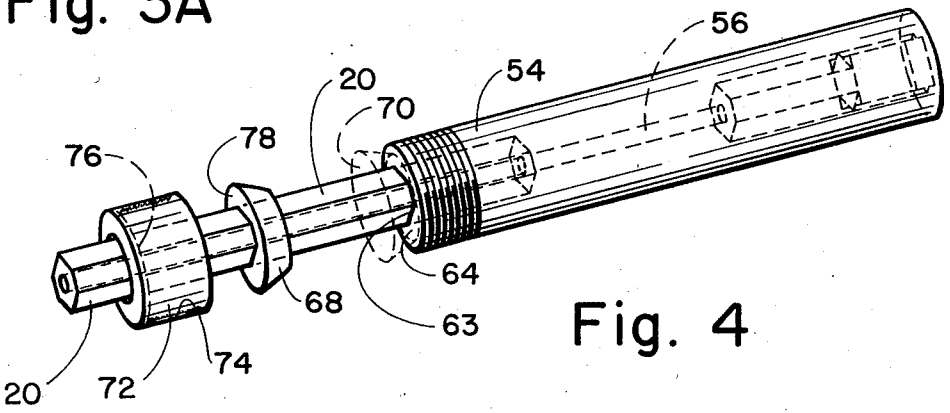
FIG. 4 shows a perspective view of the complete wrench apparatus of this invention with the resilient member, and the binding ring for holding a selected drill steel in place.

Referring now to FIG. 4, there is shown a perspective view of the drill wrench apparatus of this invention as discussed in FIG. 3 above. As can be more clearly seen, the hexagon shaped drill steel 20 is inserted in the aperture 63 of end portion 54 of the wrench. A resilient annular ring member 68 fits snugly around the drill steel and is moved into position in the concave portion 64 as is indicated by the phantom lines 70. A binding collar 72 includes inside threads 74 having a size suitable for meshing and cooperating with threads 62 on the cylindrical end portion 54 of the drill wrench. The binding collar 72 also includes a surface 76 which bears against the top portion 78 of the resilient member 68 such that when the threads 74 are mated with the threads 62 of the wrench, the collar may be tightened down against the resilient member 68. Thus, the resilient member 68 tightly grasps the hexagon shaped drive steel 20 and maintains it securely in its position within the hexagon shaped aperture 63 of the first end 54 of the drill wrench. Testing has shown that holding the drill steel 20 into the drill wrench by this technique is quite sufficient to prevent the steel from being accidentally removed from the wrench which of course could cause injury or accident. Further, it can readily be seen if the drill steel 20 were to break at a point adjacent the drill wrench, it would be a simple matter of untightening binding collar 72 to release the force on resilient member 68 such that the broken piece of drill steel could be dropped or popped out of the aperture 63 and the end of a new piece of drill steel inserted and the drilling of the ceiling hole continued. This, of course, could be done without the need of any welding or other difficult repair work on the equipment. Although it has been found that resilient member 68 may satisfactorily be made of a material such as rubber, it will also be appreciated that other resilient materials such as neoprene, plastic, nylon, and the like may also be used.

Thus, although there has been described to this point particular embodiments of the present invention which are suitable for use with presently available mine ceiling drilling apparatus, it is not intended that such specific references be considered as limitations upon the scope of this invention except insofar as is set forth in the following claims.

I claim:

1. Drill wrench apparatus for use with a bit member, drilling steel, and a drive source for drilling a hole in the ceiling of a mine for receiving ceiling bolts, said drill wrench apparatus comprising:

an elongated body portion having a first end, a central portion, and a further end, said first end defining a first selected noncircular aperture for receiving with a sliding fit the shaft of a drill bit, said central portion joining said first end to said further end, said central portion defining an aperture extending axially therethrough, said axial aperture being in register with said first selected noncircular aperture of said first end, and said further end having a cylindrical shape and defining a second selected noncircular aperture for receiving as a sliding fit an end of a drill steel, said second selected aperture extending along the axial center of said cylindrical shape of said further end and in register with said axial aperture of said central portion, and said further end further defining a concaved area axially centered with said cylindrical shape and wherein the outside surface of said cylindrically shaped further end includes threads;

an annularly shaped resilient member for being received in said concaved area snugly fitting around a drill steel inserted in said second selected noncircular aperture; and a binding ring for encircling said inserted drill steel and having a surface for bearing against said resilient member, said binding ring further having a size and threads on the inside surface of said ring for meshing and cooperating with said threads on said outside of said cylindically shaped further end so that said resilient member may be forced into said concaved area by said bearing surface when said binding ring is threaded onto said threaded further end such that said drill steel is tightly grasped by said resilient member and retained in said second noncircular aperture.

2. The drill wrench apparatus of claim 1 wherein said second selected noncircular aperture is of a hexagon shape suitable for receiving a hexagon shaped drill steel.

3. The drill wrench apparatus of claim 1 wherein said first selected noncircular shaped aperture is a hexagon shape suitable for receiving the hexagon shaped shaft of a drill bit.

4. The drill wrench apparatus of claim 2 wherein said first selected noncircular shape is a hexagon shape suitable for receiving the hexagon shaped shaft of a drill bit.

5. The drill wrench apparatus of claim 4 wherein said first and second selected noncircular apertures are the same in configuration.

6. The drill wrench apparatus of claim 1 wherein said first selected noncircular aperture is suitable for receiving and positively driving the hexagon shaped shaft of a drill bit and the square shaped head of a ceiling bolt.

7. The drill wrench apparatus of claim 2 wherein said first selected noncircular aperture is suitable for receiving and positively driving the hexagon shaped shaft of a drill bit and the square shaped head of a ceiling bolt.

8. The drill wrench apparatus of claim 1 wherein said resilient member is made of a material selected from the group consisting of rubber, neoprene, plastic and nylon.

9. The drill wrench apparatus of claim 2 wherein said resilient member is made of a material selected from the group consisting of rubber, neoprene, plastic and nylon.

10. The drill wrench apparatus of claim 7, wherein said resilient member is made of a material selected from the group consisting of rubber, neoprene, plastic and nylon.

* * * * *